United States Patent [19]

Kincaid

[11] 4,355,625

[45] Oct. 26, 1982

[54] FIREPLACE BOILER WITH AIR TIGHT FRONT AND CONTROLLED DRAFT

[76] Inventor: William C. Kincaid, 322 Sherwood Dr., Suffolk, Va. 23434

[21] Appl. No.: 77,149

[22] Filed: Feb. 6, 1980

[51] Int. Cl.[3] ..... F24B 9/04

[52] U.S. Cl. ..... 126/132; 126/120; 126/164; 126/138; 237/8 R; 237/51

[58] Field of Search ..... 126/132, 133, 139, 138, 126/53, 54, 34, 35, 152 B; 237/8 R, 51

[56] References Cited

U.S. PATENT DOCUMENTS

| | | | |
|---|---|---|---|
| 1,422,556 | 7/1922 | Gabet | 126/132 X |
| 2,172,711 | 9/1939 | Newton | 126/132 X |
| 4,046,320 | 9/1977 | Johnson et al. | 126/132 X |
| 4,112,915 | 9/1978 | Slavik | 126/121 |
| 4,159,801 | 7/1979 | Roland | 237/8 R |
| 4,159,802 | 7/1979 | Ficker et al. | 126/121 X |
| 4,191,163 | 3/1980 | Ballard | 126/132 |
| 4,197,829 | 4/1980 | Pierce | 126/121 |
| 4,219,005 | 8/1980 | Boahn | 237/51 X |

*Primary Examiner*—Larry Jones

*Attorney, Agent, or Firm*—Norman B. Rainer

[57] ABSTRACT

This fireplace boiler is designed to be placed in fireplace opening and connected to existing hot air or hot water systems to serve as an alternate means of heat and also heat domestic hot water. The boiler is designed with two (2) C shaped headers at each side with tubes traveling horizontally between headers. A steel baffle is attached to back and top of C headers in order to divert gas and heat downward to be burned for secondary heating of tubes. The attached front is of air tight construction for complete control of the fire and to secure the most heat from the least amount of fuel burned. The one half inch (½") square steel grate bars running at right angles to bottom tubes, allows for holding a bed of coals.

11 Claims, 6 Drawing Figures

FIREPLACE BOILER WITH AIR TIGHT FRONT AND CONTROLLED DRAFT

BACKGROUND OF THE INVENTION

This invention relates to a boiler for heating liquid. It slides into fireplace opening and is sealed air tight to fireplace front and has a means of controlling draft to get the most BTU's from fuel used. An open fireplace has always been a very inefficient heating device as heat from the interior of building as well as the fireplace is drawn up the flue by excessive draft. The fuel burns at too rapid a rate by not being able to control air to the fire. This causes the use of excessive fuel to keep liquid hot in previous boiler units and makes it difficult to maintain an even liquid temperature. The C shaped headers of this boiler unit allows liquid to circulate within boiler unit by convection until predetermined temperature is attained before starting circulating pump. The steel baffle directs gas and heat back downward causing gas to burn and heat to be directed toward tubes.

Previous fireplace boiler units use an expansion tank to maintain water level. When this fireplace boiler is to be used in conjunction with a forced hot air system, a storage tank of 20 gal. minimum is hooked in series with fireplace boiler. It is connected between outlet pipe of heat exchanger coil in air duct and fireplace unit. This allows for a greater volume of liquid and keeps the temperature of the liquid from fluctuating as temperature of fire in fireplace rises and falls. You do not encounter this problem in a hot water heating system, because there is volume enough to compensate for this.

SUMMARY OF THE INVENTION

The purpose of the present invention is to provide an auxiliary heating system utilizing a fireplace boiler that is safe and efficient in that it gets the most BTU's from fuel used.

The boiler unit's purpose is to connect to existing heating system (forced hot air or hot water) with automatic controls to change from conventional heat to fireplace boiler without any manual controls, or revert back to conventional heat automatically when fire in fireplace cools or goes out.

The boiler's purpose is to give an even and natural flow of liquid through multiple tubes running horizontally across fireplace to C shaped header at each side of fireplace. The inlet header is one-half ($\frac{1}{2}$) inch lower than outlet header. This gives a cross flow with a natural convection rise of hot liquid. The design also allows the liquid to circulate within the boiler unit itself by natural convection until liquid reaches pre-determined temperature and circulating pump is engaged. Another purpose of the unit is to provide an air tight front with controlled draft in order to get the most BTU's from the least amount of fuel used.

A steel baffle is attached to C shaped headers from bottom back tube upward to second top tube from rear. A second baffle extends from fireplace boiler front just above door opening toward back to a point four (4) inches above first baffle. These baffles direct heat and gas back down into fire chamber supplying additional heat to tubes. The baffles also controls heat loss up the flue. The fireplace boiler grate means attaches to the front, and liquid enters and exits the unit through fittings on either the right or left side of front. By connecting the fireplace boiler to existing heating system, heat can be distributed by hot liquid through radiators in a hot water system or by means of a heat exchanger coil in air ducts of forced air system. Blower forces air across coil picking up heat and distributing it through ducts.

Another purpose is to preheat domestic hot water by means of copper coil located in storage tank. The storage tank is a minimum of 20 gal. and is used in hot air system hooked in series with fireplace boiler. It is to increase the volume of liquid within the system so that the liquid temperature does not fluctuate as intensity of fire changes within fireplace.

When fireplace boiler is connected to a hot water heating system and a fire is built upon the grate, and a pre-determined temperature is reached, a sensor located on the front of the fireplace unit actuates the circulating pump and 3-way automatic valve. The valve located between circulating pump and the boiler, diverts the liquid to the fireplace boiler by means of conduit which is connected to fireplace boiler front. Hot liquid leaves the fireplace boiler through conduit to a 3-way automatic valve which diverts liquid to by-pass the conventional boiler until a pre-determined temperature is reached. A sensor attached to exit conduit from fireplace boiler, actuates the same 3-way valve sending liquid through the conventional boiler. At this point, the fireplace unit is heating the domestic hot water. A relay actuated by the sensor attached to the exit conduit, cuts off current to burner or conventional heating source.

DESCRIPTION OF THE PREFERRED EMBODIMENTS

Figure 1:
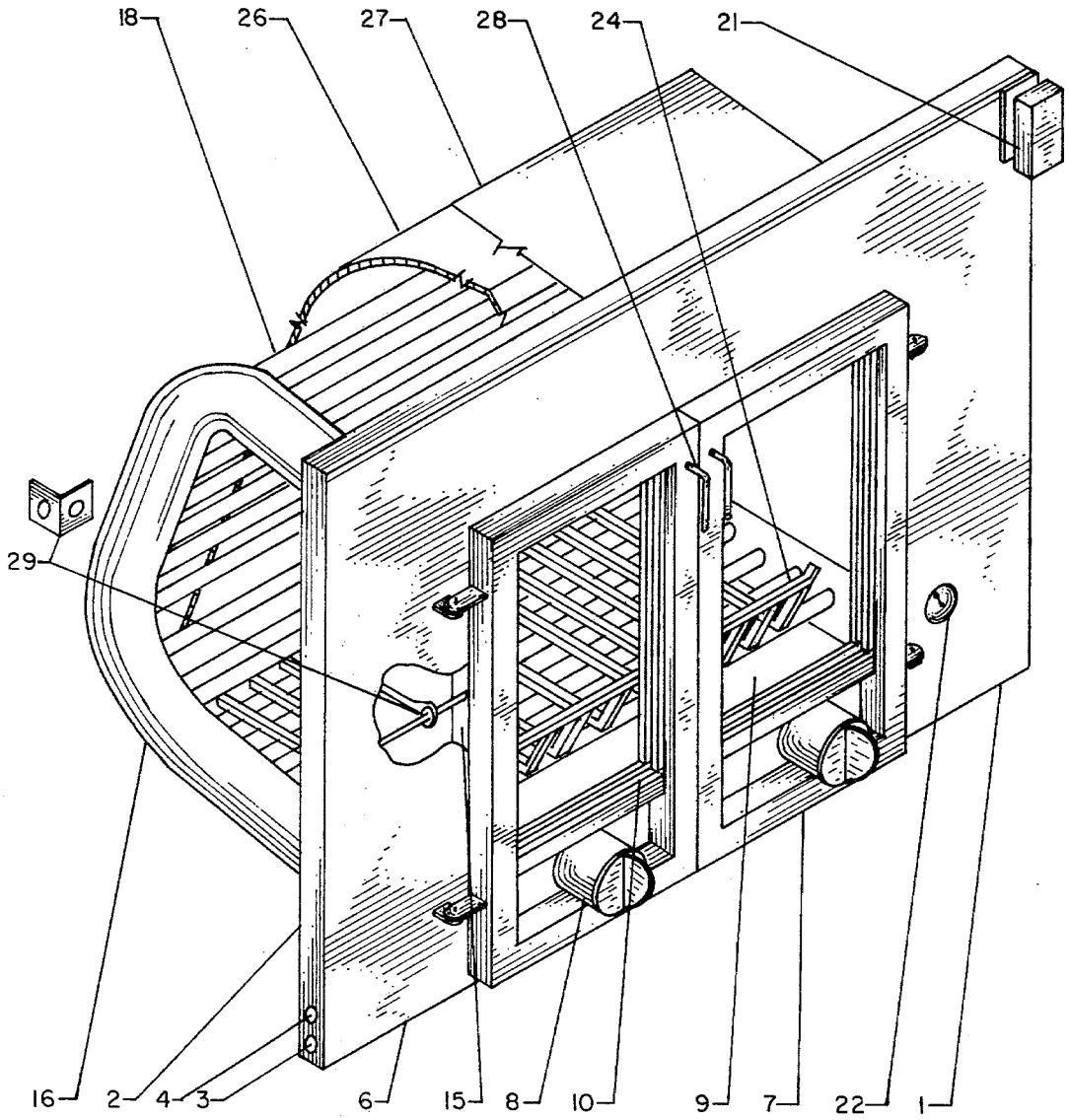
FIG. 1 is a perspective view of air tight front and water jacket of fireplace boiler.
Figure 2:
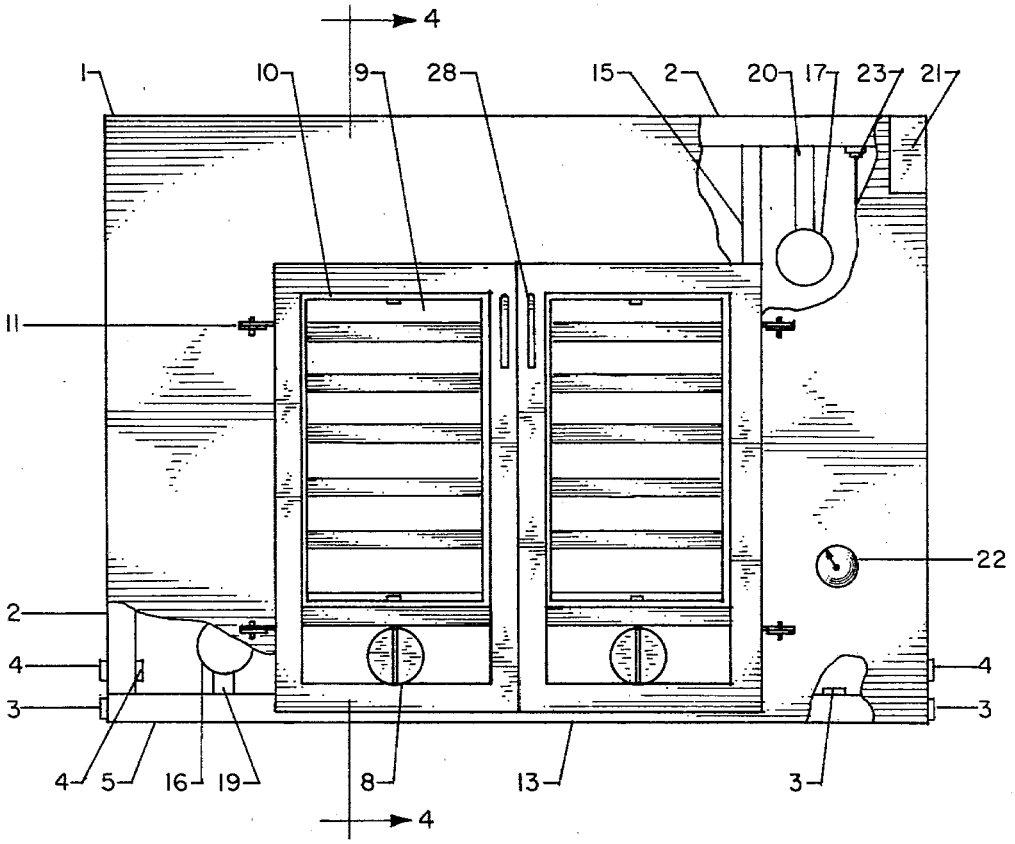
FIG. 2 is a front view of air tight front of present invention.
Figure 3:
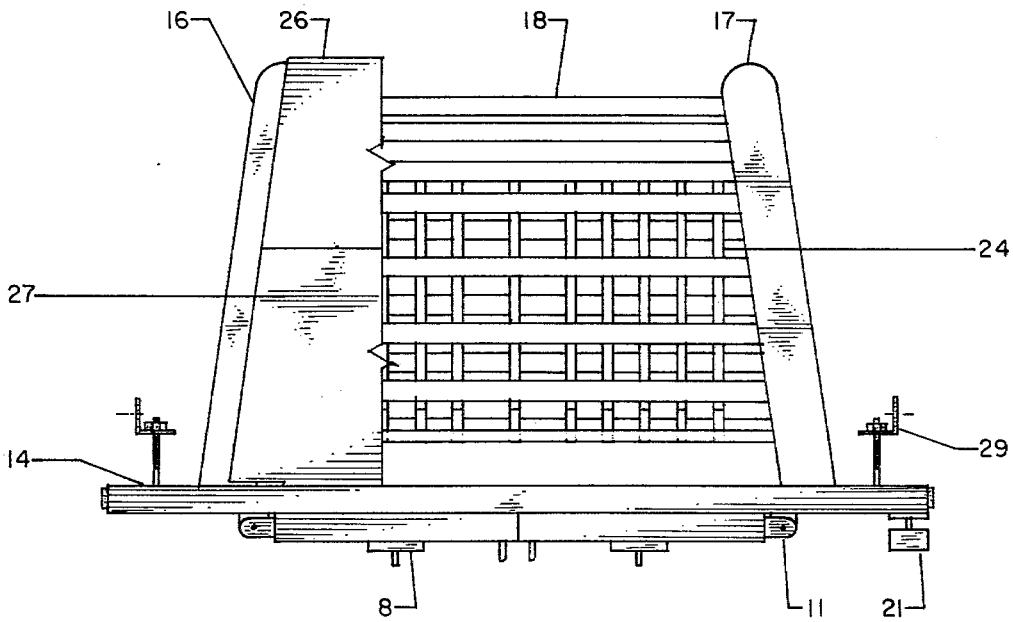
FIG. 3 is a top view of fireplace boiler and front.
Figure 4:
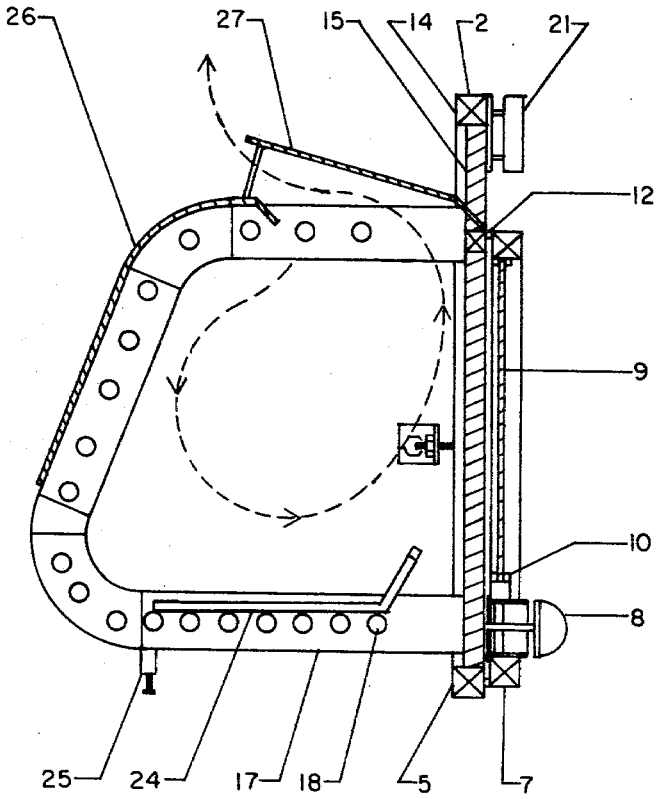
FIG. 4 is a side sectional view of fireplace boiler.

Depicted in FIG. 1 is a perspective view of fireplace boiler insert with air tight front. Item 1 (FIGS. 1–2) depicts the front of fireplace unit. Item 2 (FIG. 2) is part of tubular frame which goes around perimeter of front. The two (2) vertical outside and top tubes make up outlet tube for hot liquid exiting boiler unit. Bottom tube 5 (FIG. 2) serves as inlet tube feeding boiler unit. Fittings marked 3 (FIG. 2) allow for inlet pipe to be connected to any one of the three locations. Fittings marked 4 (FIG. 2) allow for exit line to be connected to any one of three convenient locations. The tubular front item 1 (FIG. 1) is covered with steel plate item 6 (FIG. 1). The doors of the unit item 7 (FIG. 1) are made of square tubing. The controlled drafts item 8 (FIGS. 1–4) are located at bottom of door. A glass or steel panel item 9 (FIGS. 1–2) is located in upper portion of door. The panels item 9 are held in place by $\frac{3}{8}''$ square bar frame item 10 (FIGS. 1,2 & 4) on back and front side of panels. Item 11 (FIGS. 2–3) are door hinges which allow doors to be lifted off for cleaning. Gasket item 12 (FIG. 4) is attached to doors to give an air tight closure. A gasket is applied to surfaces 13 & 14 (FIGS. 2–3). When unit is attached to fireplace, it forms an air tight unit. The controlled drafts to regulate the intensity of fire to get the most BTU's from fuel consumed is found in item 8 (FIGS. 2 & 4). The fireplace boiler grate means item 1 (FIG. 1) is constructed with two C shaped headers item 16 & 17 (FIGS. 1 & 3) with a plurality of tubes item 18 (FIG. 3) running horizontally between C headers. Spacing between tubes is no less than diameter of tubes and no greater than 1½ times diameter of tubes. With this header and tube arrangement, liquid can circulate by convection until pre-determined temperature is reached and circulating pump starts. The C shaped headers 16 & 17 are attached to front item 1. Header 16 is attached to front inlet tube 5 (FIG. 2) by pipe item 19 (FIG. 2). Header 17 is attached to front exit tube item 2 (FIG. 2) by pipe item 20 (FIG. 2). Heat sensor item 21 (FIG. 2) is located at top right or left corner of front item 1 above exit 4 being used. Item 15 (FIGS. 2 & 3) is square tubular frame around door opening. Thermometer item 22 (FIG. 2) indicates temperature of liquid. Once the needed liquid temperature is determined for desired structure or building temperature, the fire can be controlled to maintain the desired water temperature. Item 23 (FIG. 2) is temperature sensory tube for thermometer.

Square bar grate item 24 (FIGS. 3 & 4) is welded to top side of bottom tubes running front to back at right angle to tubes; spacing same as tubes. This gives a square hole effect to the grate. This arrangement keeps coals from falling to ash pit causing fuel to burn to a fine ash. The square bars also give more rigidity to tubes. The square bars extend upward at a 45 degree angle at the front and prevents fuel from falling out when doors are opened. Item 25 (FIG. 4) are adjustable rear legs.

Baffle item 26 (FIG. 4) extends from bottom rear tubes up back and over top two tubes at back with a 45 degree break downward. This directs heat and gas back down giving additional heat to tubes. Baffle item 27 (FIG. 4) acts as a restricting baffle, preventing heat loss directly up the flue as illustrated in FIG. 4. Item 28 (FIG. 2) are handles for locking and opening doors. Item 29 (FIG. 1) is the anchoring device for attaching the unit to the fireplace. It is made up of an eye bolt which is attached to a rod which is secured to fireplace boiler front. An angle iron clip is bolted to the brick interior of fireplace, and the eye bolt pulls the unit tight to front of fireplace opening.

The fireplace boiler can be connected to hot water or forced hot air systems.

Figure 5:
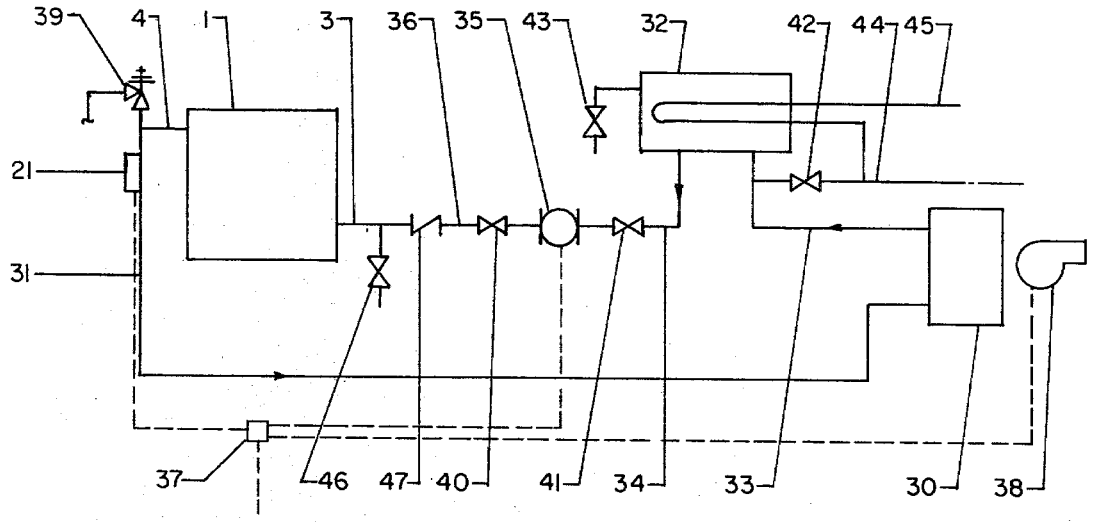
FIG. 5 is a schematic of hot air arrangement.

To connect fireplace boiler to forced hot air system, place unit in fireplace cavity and seal to fireplace opening. The fireplace boiler exit opening 4 (FIGS. 2 & 5) is connected to a heat exchanger coil item 30 (FIG. 5) by conduit 31, thence to storage-expansion tank item 32 (FIG. 5) by conduit 33 (FIG. 5). From storage tank 32 (FIG. 5), conduit 34 connects to circulating pump 35, then conduit 36 goes to fireplace inlet 3.

When fire is placed on grate 24 (FIG. 4), and the liquid reaches pre-determined temperature, sensor 21 (FIG. 5) actuates relay 37 (FIG. 5) which engages circulating pump 35 and also starts blower 38 (FIG. 5). The blower then draws air across heat exchanger coil and distributes warm air through air ducts to house or structure. Item 39 (FIG. 5) is a safety relief valve. Items 40 and 41 (FIG. 5) are gate valves to isolate pump for repairs. Fill system with valve 42 (FIG. 5) until liquid comes from over flow on storage tank 32, then close valve 43 (FIG. 5).

Domestic hot water is pre-heated by coil in storage tank 32. Cold water enters through line 44 and exits through line 45 going to domestic hot water heater. Valve 46 (FIG. 5) is for draining system. This should be located at lowest point in system. Item 47 (FIG. 5) is a check valve to control flow direction.

Figure 6:
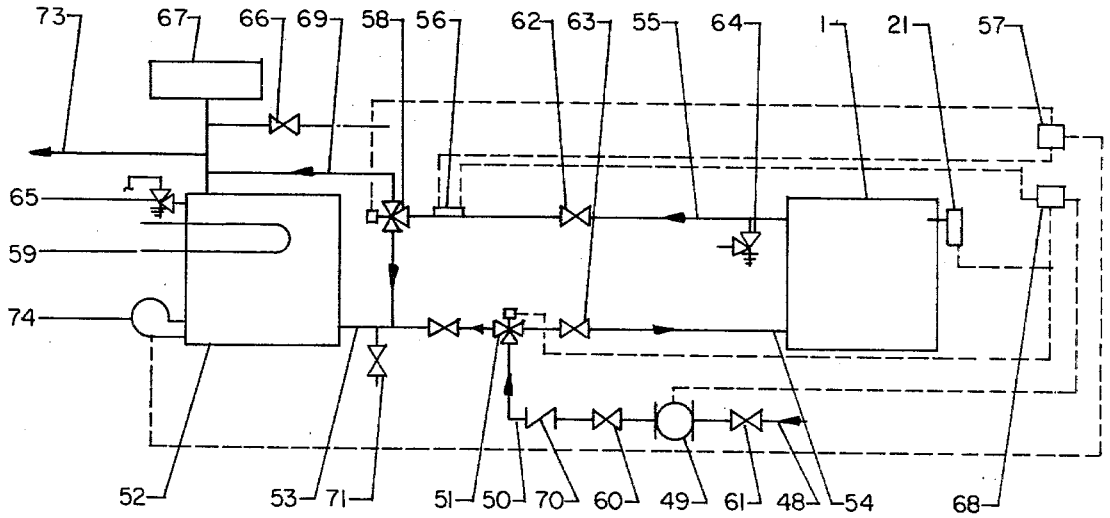
FIG. 6 is a schematic of hot water system arrangement.

When connecting fireplace boiler to a hot water system (FIG. 6), the fireplace boiler unit is placed in fireplace cavity. Conduit 48 (FIG. 6), the return line from hot water heating system, is connected to circulating pump 49 (FIG. 6). Conduit 50 (FIG. 6) connects circulating pump 49 to automatic 3-way diverting valve 51 (FIG. 6). The valve is normally open toward conventional boiler 52 through conduit 53 (FIG. 6). When fire is built upon grate 24 (FIG. 4), and the heat sensor aquastat item 21 (FIGS. 4 and 6) reaches pre-determined temperature, valve 51 opens to fireplace boiler item 1 (FIG. 6) allowing liquid to flow through conduit 54 to fireplace boiler item 1 (FIG. 6). Sensor 21 also engages relay 68 which starts pump 49. The liquid leaves fireplace boiler item 1 (FIG. 6) through conduit 55 to 3-way automatic valve 58. Normal position of valve 58 by passes conventional boiler 52. This is done to prevent conventional boiler from cycling until fireplace builds up it's heat. At a pre-determined temperature, approximately 150 degrees, but not limited to this, sensor 56 (FIG. 6) actuates relay 57 (FIG. 6). Relay 57 (FIG. 6) actuates 3-way automatic valve 58 sending liquid through boiler 52 and cuts off current to conventional boiler's heat source. When the liquid is diverted through boiler 52, the fireplace unit item 1 (FIG. 8) is then heating the domestic water through coil 59 in boiler 52 and building or structure through radiators. Valves 60 and 61 are for isolating pump 49 for repairs. Valves 62 and 63 are for isolation of fireplace boiler item 1 (FIG. 6). Items 64 and 65 (FIG. 6) are relief valves to protect against pressure build up. Valve 66 is for filling system. Item 67 is an expansion tank. Line 69 carries liquid to radiators. Check valve 70 is to control direction of flow. Item 71 is the drain valve. Item 72 is cut off valve. Item 73 (FIG. 6) is feed line to radiators. Item 74 (FIG. 6) is heat source for conventional boiler (oil, gas, electric or other).

The embodiments of the invention in which an exclusive property or privilege is claimed as follows:

1. A water-heating device adapted to be placed in a fireplace cavity having a front opening comprising (a) a vertically disposed front steel wall of substantially rectangular periphery having front and rear surfaces and adapted to make an airtight fit with the front opening of said fireplace cavity, (b) two substantially identical C-shaped headers disposed in upright manner in mirror image relationship adjacent each vertical side of said steel wall, each header consisting of a back portion and forwardly extending portions emerging from the upper and lower extremities of said back portion and communicating therewith, said back portions being spaced closer together than said forwardly extending portions, the forwardmost extremities of said forwardly extending portions being attached to and sealed by the rear surface of said steel wall, (c) a plurality of horizontal tubes extending between said headers and communicating therewith, (d) a series of substantially parallel spaced apart bars attached to the top sides of those horizontal tubes extending between the lower forwardly extending portions of said header, and perpendicular thereto, thereby forming a grate capable of supporting combustible solid fuel, (e) conduit means associated with the rear surface of said steel plate adjacent the outer periphery thereof, said conduit means comprising upper and lower horizontal members and opposed side members, said upper and side members being continuous and in communication with an upper forwardly extending portion of a header, and said lower horizontal member communicating with a lower forwardly extending portion of a header, (f) means associated with said lower horizontal member of said conduit means to permit ingress of water to be heated, (g) means associated with said conduit means, above the means permitting ingress of water, to permit removal of heated water, (h) means for sensing the temperature of water within said conduit means adjacent the upper portion of said steel plate, (i) first baffle means disposed at the rear of said device and behind said horizontal tubes adapted to reflect heat toward said grate, and (j) a hinged door substantially centered within said steel plate adapted to admit solid fuel to said grate.

2. The device of claim 1 wherein the forwardmost extremities of said bars are upturned to provide improved retention of said solid fuel.

3. The device of claim 1 wherein a second heat reflective baffle means is positioned above the horizontal tubes associated with the upper forwardly extending portions of said header.

4. The device of claim 3 wherein said second baffle means is positioned with respect to said first baffle means in a manner to define therebetween a vent for the upward passage of combustion gasses.

5. The device of claim 1 wherein the cross-sectional area of the headers is greater than the cross-sectional area of said horizontal tubes.

6. The device of claim 5 wherein the spacing between adjacent horizontal tubes is between 1 and 1.5 times the diameter of said tubes.

7. The device of claim 1 wherein adjustable means to admit air to said grate are associated with said steel plate.

8. The device of claim 1 wherein pump means communicate with said means permitting removal of heated water.

9. The device of claim 1 wherein a storage tank communicates with said means permitting removal of heated water.

10. The device of claim 1 wherein a heat-exchanger communicates with said means permitting removal of heated water.

11. The device of claim 1 wherein said conduit means associated with the rear surface of said steel plate have a square cross-sectional configuration.

* * * * *